United States Patent [19]

Karkanen

[11] Patent Number: 4,507,807

[45] Date of Patent: Apr. 2, 1985

[54] WORK GLOVE FINGER STRUCTURE

[76] Inventor: Kip M. Karkanen, 256 Castle Glen Rd., Walnut Creek, Calif. 94595

[21] Appl. No.: 485,696

[22] Filed: Apr. 18, 1983

[51] Int. Cl.[3] ..... A41D 19/00

[52] U.S. Cl. ..... 2/161 R; 2/21; 2/163

[58] Field of Search ..... 2/21, 161 R, 161 A, 2/163, 167, 168

[56] References Cited

U.S. PATENT DOCUMENTS

| | | | |
|---|---|---|---|
| 474,929 | 5/1892 | Tabor et al. | 2/163 |
| 2,058,221 | 10/1936 | Ferguson | 2/168 |
| 2,138,626 | 11/1938 | Copen | 2/21 |
| 2,348,773 | 5/1944 | Wyman | 2/21 |
| 2,705,327 | 4/1955 | Gitt | 2/161 |
| 3,098,237 | 7/1963 | Slimovitz | 2/164 |
| 3,386,104 | 6/1968 | Casey | 2/161 |
| 4,094,014 | 6/1978 | Schroeder | 2/161 R |
| 4,131,952 | 1/1979 | Brenning | 2/2 R |

*Primary Examiner*—Louis K. Rimrodt

*Attorney, Agent, or Firm*—Townsend and Townsend

[57] ABSTRACT

A work glove in which the tips of one or more fingers of the glove are made of relatively pliable, stretchable material for increased sensitivity at the user's fingertips. A ring or band of high friction material coats the inside surface of the fingers, typically just below where the high sensitivity tips are attached to a portion of the glove fingers. The user inserts his or her fingers fully into the glove's fingers until the flexible tips are drawn tightly over the user's fingertips. The high friction band inhibits movement of the high sensitivity tip to keep the tip tightly drawn over the user's fingertip.

12 Claims, 4 Drawing Figures

WORK GLOVE FINGER STRUCTURE

BACKGROUND OF THE INVENTION

Work gloves are often used to protect one's hands and fingers from injury. One of the problems with protective work gloves is that the thickness and toughness of the material, as well as the method of construction, required for sufficient protection generally results in a loss in sensitivity at the user's fingertips.

One method for increasing sensitivity is to use relatively thin, tight fitting molded vinyl, neoprene or latex rubber gloves, such as are sold for use while washing dishes. A problem with such tight fitting gloves is that they are usually quite thin so they do not provide sufficient protection against cuts, abrasions, punctures, burns and other similar injuries to the user's hand. Also, the lack of air circulation creates excessive perspiration buildup causing general hand discomfort as well as loss of sensitivity at the finger tips. These types of gloves are therefore unsuitable for use for extended time periods and in many environments.

U.S. Pat. No. 3,098,237 to Slimovitz discloses a glove having slits in the lining of the fingers of the glove. This allows the user to insert his or her fingers between the lining and the shell for increased sensitivity. Although this type of glove can increase the sensitivity at the user's fingertips without sacrificing the protective qualities of the remainder of the glove, there is still a marked reduction in sensitivity compared with tight fitting rubber gloves. The existence of seams in the finger tips also reduces the glove's sensitivity.

SUMMARY OF THE INVENTION

The present invention is directed to a work glove in which the tips of one or more fingers of the glove are made of relatively pliable and durable material without finger tip seams thereby increasing sensitivity at the user's fingertips. A ring or band of high friction material coats the inside surface of one or more of the fingers, typically just below where the high sensitivity tips are attached to the base of the glove fingers. In use the user inserts his or her fingers fully into the glove fingers until the flexible tips are drawn tightly over the user's fingertips. The high friction band inhibits movement of the high sensitivity tip to keep the tip tightly drawn over the user's fingertip for maximum sensitivity.

A primary feature of the present invention is its combination of a relatively loose protective glove body, which prevents excessive perspiration buildup on the hand, combined with high sensitivity fingertips. Because the high sensitivity tips are kept tightly drawn over the user's fingertips, optimum sensitivity at the user's fingertips is achieved with minimal degradation of comfort and protection over the rest of the hand.

Other features and advantages of the present invention will appear from the following description in which the preferred embodiments have been set forth in detail in conjunction with the accompanying drawings.

DETAILED DESCRIPTION OF THE PREFERRED EMBODIMENTS

Figure 1:
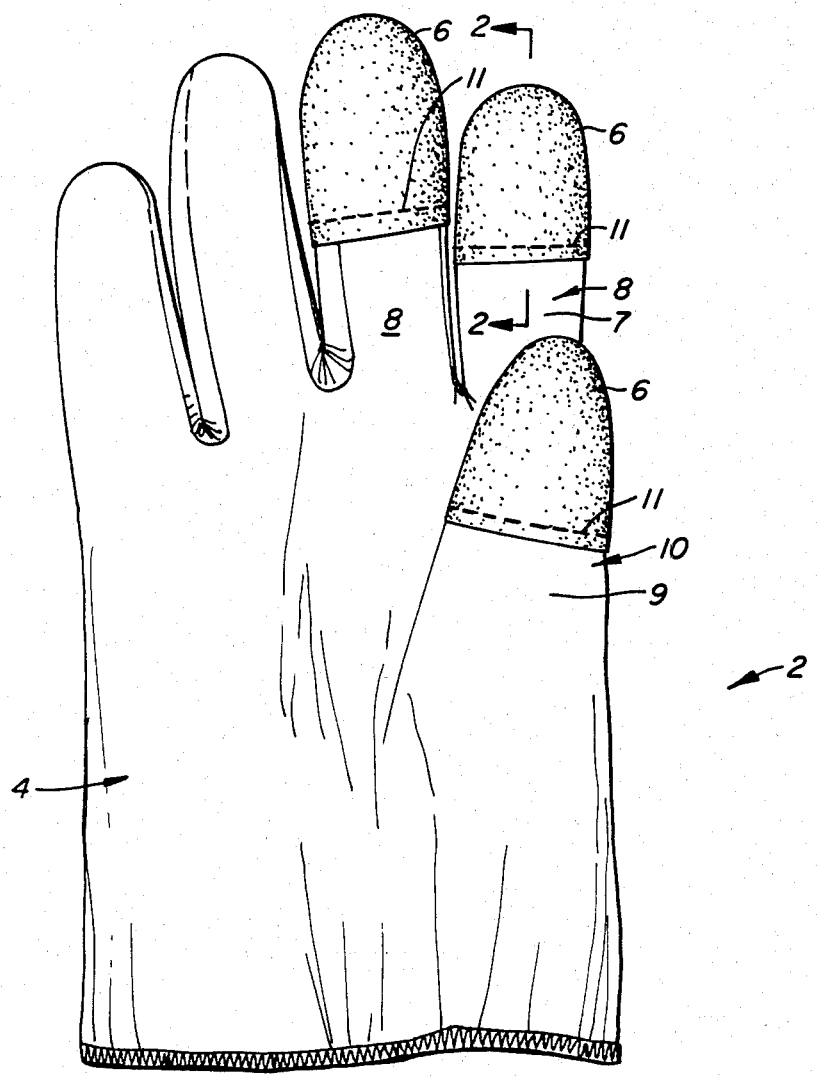
FIG. 1 is an overall view of the work glove made according to the present invention.
Figure 2:
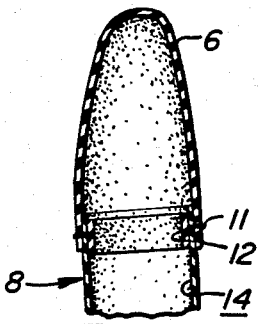
FIG. 2 is a cross-sectional view taken along line 2—2 of FIG. 1.

Referring now to FIGS. 1 and 2, work glove 2 is shown including a protective glove body 4 to which high sensitivity tips 6 are mounted at the end of several glove fingers 8 and thumb 10. Glove finger 8 and thumb 10 include glove finger bases 7 and glove thumb base 9 to which tips 6 are attached. Tips 6 are attached to fingers 8 and thumb 10 in a suitable manner, such as by gluing, vulcanization or sewing at 11. The glove body 4 is made of a suitable fabric which has been coated by a suitable material such as neoprene or nitrile butyl rubber. The high sensitivity tips 6 are made of a suitable pliable material such as neoprene or nitrile butyl rubber which is molded to surround the finger tips and is thin and pliable enough as to not significantly decrease fingertip sensitivity. Being seamless, tips 6 are more comfortable and provide increased sensitivity compared with glove finger tips having seams.

A ring or band 12 of high friction material is applied to the inside surface 14 of glove finger base 7 and thumb base 9 adjacent tips 6. High friction ring 12 is of a material, such as silicone rubber, which exhibits high friction or tackiness to movement across a user's skin. Fingers 8 and thumb 10 are preferably made somewhat shorter than usual to assure the ends of the user's fingers contact the ends of tips 6.

In use the user inserts his or her fingers fully into fingers 8 and thumb 10 of work glove 2 until flexible tips 6 tightly cover the user's fingertips. The friction between band 12 of silicon rubber and the user's skin inhibits its movement over the user's fingers and thumb. This keeps the flexible, high-sensitivity tips 6 tightly drawn over the user's fingertips. Protective glove body 4 can be sized to be relative loose fitting for comfort and can be made of thicker, tougher material than tips 6 for protection against injury.

Figure 3:
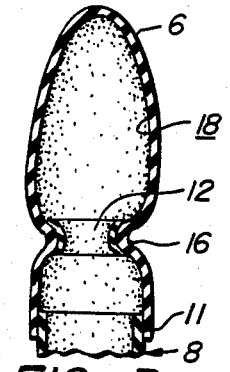
FIGS. 3 nd 4 are views similar to FIG. 2 of two alternative embodiments of the invention.
Figure 4:
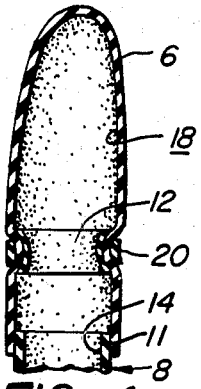

Turning to FIG. 3, an alternative embodiment of finger tip 6 is seen to include a molded constriction portion 16 about its circumference. High friction band 12 is applied to the inner surface 18 of tip 6 in the region underlying constriction portion 16. Constriction portion 16 increases the friction between the user's finger and band 12 to help keep tip 6 taut over the user's finger tip. Instead of using molded constriction portion 16, a resilient constricting band 20, shown in FIG. 4, can be applied to the outside of tip 6 thereby constricting band 12 against the user's finger. Resilient constricting band 20 may also be placed about the glove finger bases 7, 9, or mounted to inside surfaces 18, 14 of tips 6 or glove finger bases 7, 9, with band 12 being generally surrounded by constricting band 20.

Modification and variation can be made to the disclosed embodiments without departing from the subject of the invention as defined in the following claims. For example, glove fingers 8 and thumb 10 may be completely made of the high-sensitivity material of tips 6. Also, it may be desired to make the entire work glove out of a single type of material. The high friction band 12 applied to the fingers of the glove would still act to keep the tips of glove fingers 8 tightly drawn against the user's fingertips for increased sensitivity.

I claim:

1. A glove of the type having a glove body including a relatively loose fitting palm covering portion and at least one glove finger with an inside surface the improvement comprising:

a band of high-friction material applied to said inside glove finger surface to allow at least the tip of said glove finger to be frictionally retained and tightly drawn over a user's finger inserted therein while allowing the remainder of said glove body to be relatively loose fitting.

2. The glove of claim 1 wherein said glove body includes four fingers and a thumb.

3. The glove of claim 1 wherein said glove includes a plurality of fingers, at least two of which include said high-friction band.

4. The glove of claim 1 wherein said glove finger includes a high sensitivity tip portion.

5. The glove of claim 4 wherein said high sensitivity tip portion extends part way down said glove finger.

6. The glove of claim 4 further comprising constricting means mounted about said high friction band thereby increasing friction between the user's finger and said high friction band.

7. The glove of claim 6 wherein said constricting means is formed as a molded portion of said tip portion.

8. The glove of claim 1 further comprising constricting means mounted about said high friction band thereby increasing friction between the user's finger and said high friction band.

9. The glove of claim 8 wherein said constricting means includes a resilient band.

10. The glove of claim 9 wherein said resilient band is mounted about the outside of said glove finger to circumscribe said glove finger.

11. A glove finger for use with a work glove of the type having a protective glove body including a relatively loose fitting palm covering portion and a glove finger, said glove finger including:

a base portion and a tip portion, said tip portion being of relatively high-sensitivity, stretchable material sized for a tight fit over the tip of a user's finger inserted therein; and a band of high friction material applied to an inside surface of said glove finger to keep said tip portion snuggly drawn over the user's finger tip while permitting other portions of said glove body to be relatively loose fitting.

12. The glove finger of claim 11 further comprising constricting means surrounding said high friction band to increase friction between said high friction band and the user's finger.

* * * * *